US006203509B1

(12) United States Patent
Duboff

(10) Patent No.: US 6,203,509 B1
(45) **Date of Patent: *Mar. 20, 2001**

(54) FINGERTIP MASSAGER

(75) Inventor: Gary Duboff, Bay Harbor Islands, FL (US)

(73) Assignee: Finger Fitting Products, Inc., Miami, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/060,595

(22) Filed: Apr. 15, 1998

(51) Int. Cl.[7] ..... A61H 23/02; A61H 7/00
(52) U.S. Cl. ..... 601/70; 601/72; 601/138
(58) Field of Search ..... 601/46, 48, 67, 601/70, 72, 73, 74, 79, 80, 81, 137, 138

(56) References Cited

U.S. PATENT DOCUMENTS

| | | | | |
|---|---|---|---|---|
| 2,286,089 | | 6/1942 | Harris . | |
| 2,287,501 | * | 6/1942 | Thomas . | |
| 2,350,817 | | 6/1944 | Purves et al. . | |
| 2,686,325 | * | 8/1954 | Silver | 401/7 |
| 2,918,055 | | 12/1959 | Boerger . | |
| 3,461,859 | * | 8/1969 | Fortnam . | |
| 3,623,481 | | 11/1971 | Curran . | |
| 4,116,233 | | 9/1978 | Scaduto . | |
| 4,308,860 | * | 1/1982 | Sanders et al. . | |
| 5,519,292 | | 5/1996 | Taylor et al. . | |
| 5,601,529 | | 2/1997 | Wollman . | |

FOREIGN PATENT DOCUMENTS

| | | | | |
|---|---|---|---|---|
| 59368 | * | 5/1954 | (FR) | 601/79 |

* cited by examiner

*Primary Examiner*—Danton D. DeMille
(74) *Attorney, Agent, or Firm*—Wallenstein & Wagner, Ltd.

(57) ABSTRACT

A massaging device for securing to a single finger of a user. This massaging device includes a housing and a motor for vibrating the housing. A power source, such as a conventional or rechargeable battery, is provided for powering the motor. A securing strap is provided for attaching the device to the single finger of a user. A plurality of panels are attachable to and detachable from the housing for vibration with the housing.

15 Claims, 2 Drawing Sheets

FINGERTIP MASSAGER

TECHNICAL FIELD

The invention is directed to a massager, and particularly to a finger massager that is securable to the single finger of a user, and which includes a plurality of panels attachable to and detachable from the housing of the massager for vibration with the housing.

BACKGROUND OF THE INVENTION

Battery-powered massaging devices are well-known in the art. Some of these massaging devices have been described in prior art patents. Examples of these patents include U.S. Pat. Nos. 5,601,529, 5,519,292, 4,116,233, 3,623,481, 2,918,055, 2,350,817, and 2,286,089.

U.S. Pat. Nos. 5,601,529 and 5,519,292 are both directed to finger massage apparatuses that are mountable on the hand and wrist of the user, as may be seen in their FIGS. 1.

U.S. Pat. No. 4,116,233 is mountable to all four fingers of one hand, and includes a large, apparently smooth and fixed massage ball 7.

U.S. Pat. No. 3,623,481 is mounted to only one finger of the user. However, this device include no panels that are vibrated by housing. Instead, the vibrator shown in the '481 patent transmits vibrations to the finger to which it is attached. The vibrations are, in this way, imparted to the finger. The finger is then placed in the mouth of the user to massage the gums.

U.S. Pat. Nos. 2,918,055 and 2,350,817 are both directed to hand massagers. Both of the devices depicted in these patents are secured to several fingers of the user. These devices also impart vibratory forces to the hand of the user, which is in turn used for massaging either the user or another.

U.S. Pat. No. 2,286,089 is directed to a hand attachment means for a vibrator. This device is secured to three fingers of a user.

SUMMARY OF THE INVENTION

The invention is a massaging device for securing to a single finger of a user. This massaging device includes a housing and a motor for vibrating the housing. A power source, such as a conventional or rechargeable battery, is provided for powering the motor. A securing strap is provided for attaching the device to the single finger of a user. The securing strap may be flexible or rigid. Finally, the device includes a plurality of panels attachable to and detachable from the housing for vibration with the housing.

A further aspect of the invention includes panels which have ridges of varying shapes. Preferred securing straps can be either a hook and loop fastener, an elastic securing strap, or a rigid, spring-held mechanism.

The housing may include a first portion and a second portion. The second portion may contact the finger of the user on the underside of the finger. The first portion is removably attached to the second portion for access to and servicing of internal components, including the motor.

DETAILED DESCRIPTION OF THE PREFERRED EMBODIMENT

The invention is shown generally in the FIGS. 1–8. As may be seen in FIG. 1, the invention is a massaging device 10 that is specifically made for securing to the single finger of a user.

Figure 1:
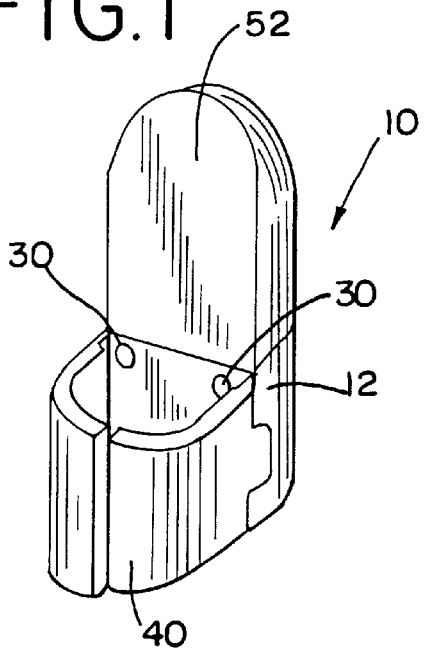
FIG. 1 is a rear, perspective view of one embodiment of the invention, with a rigid, spring-tension mechanism.
Figure 2:
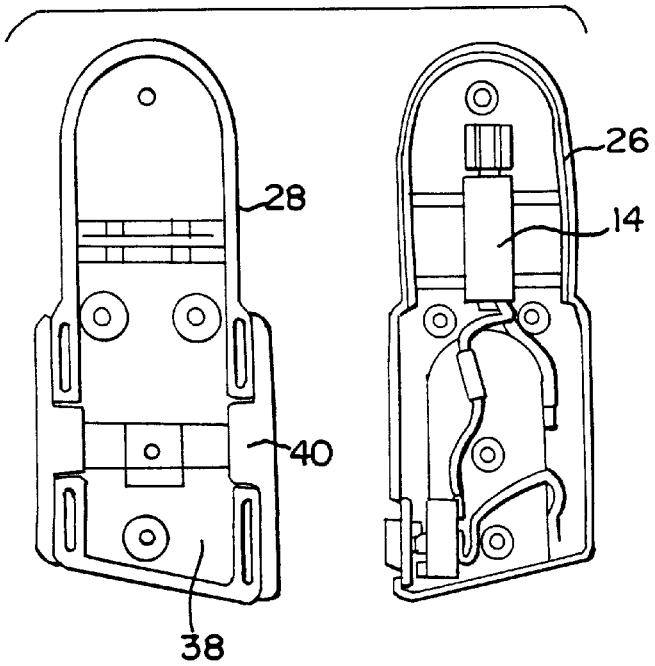
FIG. 2 is a view of the device of FIG. 1, but from overhead with the first portion and second portion of the housing of the device separated from each other.

FIG. 2 shows the device of FIG. 1, but with the main housing 12 separated into its two main component parts. As can be seen from FIG. 2, separating this massaging device 10 into its two parts discloses a motor 14 for vibrating the housing 12.

As may be seen in FIG. 2, this housing 12 may include a first portion 26 and a second portion 28. The second portion 28 of the housing 12 abuts against the topside of the finger of the user. The first portion 26 is removably attached, as by a plurality of screws 30, to the second portion 28. As may be seen in FIG. 2, when the first portion 26 is detached from the second portion 28, one may obtain access to the motor 14 for its servicing or replacement. A power source, such as a pair of conventional or rechargeable batteries 16 (FIG. 3), is provided for powering the motor 14. The batteries 16 may be accessed by removal from the housing 12 of the battery access panel 36.

A securing strap is provided for attaching the device 10 to the single finger of a user. Preferred securing straps can be either straps with a hook and loop fastener 22, as shown in FIG. 4, or an elastic securing strap 24, as shown in FIG. 8.

Figure 3:
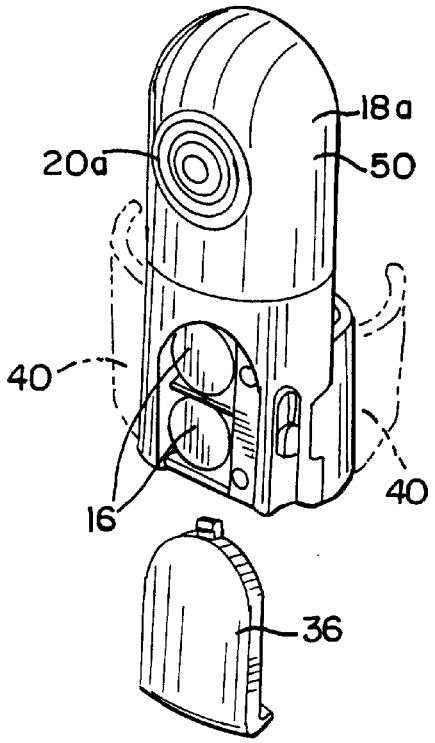
FIG. 3 is a perspective view of the device of FIG. 1, but with a battery access panel removed to expose a pair of conventional batteries.

Another preferred securing strap is that shown in FIGS. 1–3 and 5–6. These so-called "wing straps" 40 are made of a relatively hard material. They can be in either a closed position (FIGS. 1–2 and 5–6), in which they grip the finger of the user; or an open position (as shown in FIG. 3), for releasing the device from the finger of the user. A spring 38 biases the wing straps 40 into their closed position, and aids in retaining the wing straps 40 in their open position.

Figure 4:
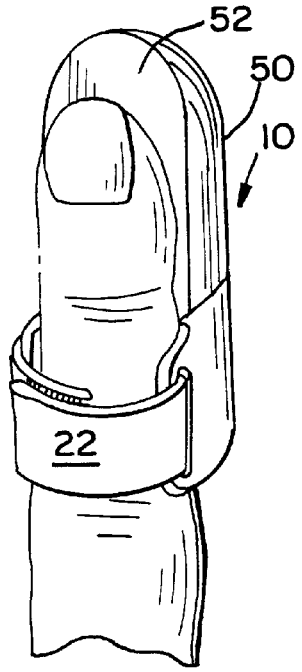
FIG. 4 is a view of the device of FIG. 1, but with a hook and loop-type fastening strap, and secured to the finger of a user.
Figure 8:
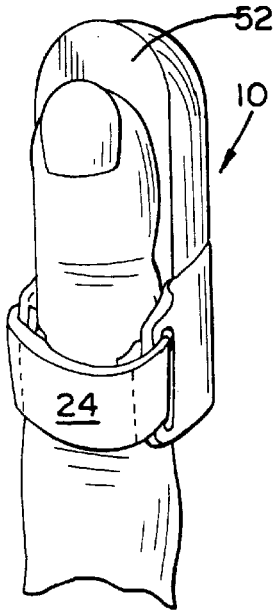
FIG. 8 is a perspective view of a device like that of FIG. 1 or 4, but with an elastic strap.

The devices shown in FIGS. 4 and 8 are virtually identical to that of FIG. 1, except for the hook and loop fastening strap 22 or the elastic strap 24, respectively, for securing the massaging device 10 to the finger of the user.

Figure 6:
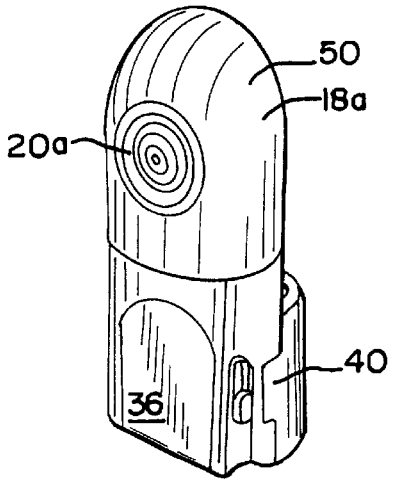
FIG. 6 is a view of the device of FIG. 5, but with a panel secured to the acceptance region of the housing.
Figure 7:
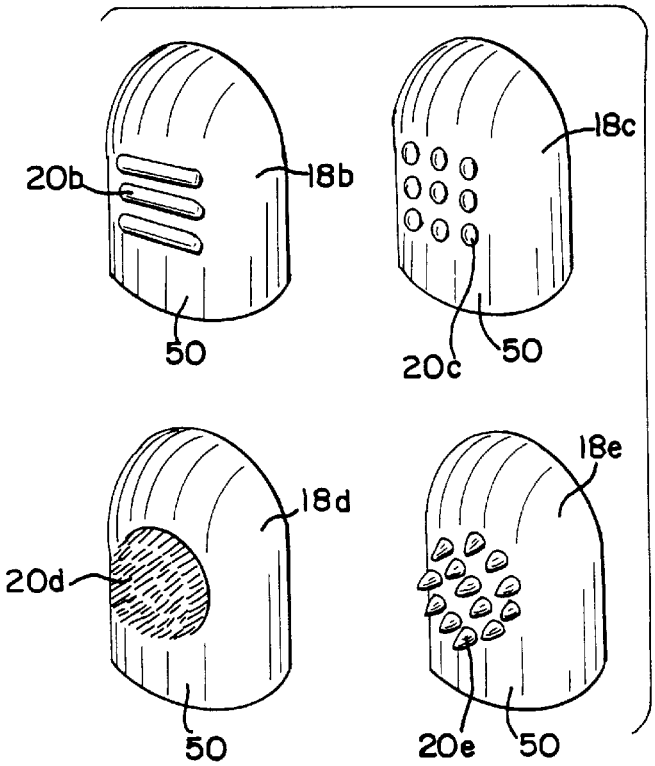
FIG. 7 is a perspective view of several exemplary panels that may be used with the massaging device of the invention.

Finally, the device 10 includes one of a plurality of panels 18*a*–18*e* attachable to and detachable from the housing 12 for vibration with the housing 12. FIGS. 3 and 6 show panels 18*a* which include a bulls-eye type 20*a* of ridge. Examples of other kinds of panels 18*b*–18*e* having various other types of ridges or projecting features that may be used with the device 10 are shown in greater detail in FIG. 7. FIG. 7 shows these panels have ridges or projecting features 20*b*–20*e* of varying shapes.

Figure 5:
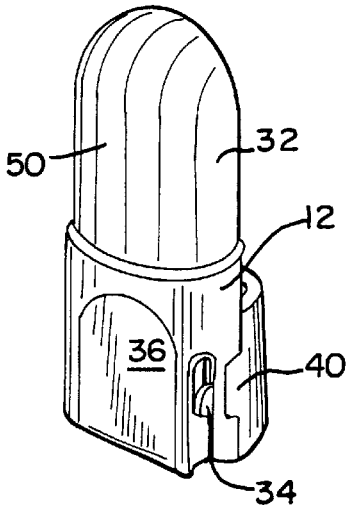
FIG. 5 is a front, perspective view of the device of FIG. 1, showing the so-called acceptance region of the housing.

As may be seen in FIG. 5, a frontal view of the device of FIG. 4 shows an acceptance region 32 of the housing 12. The acceptance region 32 provides an area on the housing 12 to which the panels 18 may be secured.

FIG. 6 shows one of the many different panels 18*a*. In this FIG. 6, the panel 18*a* has been slidably placed over the end of the acceptance region 32 of the device 10. This FIG. 6 shows that panel 18*a* secured to the acceptance region 32 of the housing 12. The panels 18 are made of a elastomeric or rubber-like material. The panels 18*a*–18*e* have an opening (not shown) at their bottoms, and are hollow. They are dimensioned so as to provide a tight, friction fit over the acceptance region 32.

Like panel 18*a,* any of the panels 18*b*–*e* of FIG. 7 can be secured to the acceptance region 32 of the housing 12. With these panels 18 secured to the acceptance region 32 of the housing 12, the massaging device 10 can be started with its on-off switch 34. Vibration is transmitted from the motor 14 to the housing 12, and then to the panels 18. The user then places the vibrating panels 18 onto the appropriate area of the person to be massaged. Differences in the ridges 20 on panels 18 create different sensations on the person being massaged.

What is claimed is:

1. A finger shaped massage device adapted to be secured to only a single finger of a user for contacting an another area to be massaged, the massaging device comprising:

a housing having a width substantially that of the width of a finger, the housing further having a tip end and a base end opposite the tip end;

a panel attached to the housing, said panel having a massaging surface for contacting the another area to be massaged and a finger contacting area on the opposite side of the device from the massaging surface that contacts the single finger of the user, the housing and the panel creating an exterior shape;

a motor for vibrating the massaging device; and, a securing strap fixedly attached to the housing toward the base end of the housing, for securing the massaging device to only the single finger of the user wherein, the device is strapped to the single finger of the user forming a similar profile as the finger and the massaging surface contacts the another area to be massaged and the finger contacting area contacts the single finger of the user, wherein a top half and a bottom half of the exterior shape is viewable from the tip end by a plane separating the massaging surface from the finger contacting area, the top half being asymmetrical to the bottom half when viewed from the tip end, and wherein at least one transverse cross section of the exterior shape is non-polygonal.

2. The massaging device of claim 1 wherein the securing strap is a rigid, two-piece clamp.

3. The massaging device of claim 1 wherein the panel is removably attached to the housing.

4. The massaging device of claim 1 wherein the massaging surface of the panel has at least one protrusion for giving the massaging surface texture, thereby enhancing the massaging.

5. A finger shaped massage device adapted to be secured to only a single finger of a user for contacting an another area to be massaged, the massaging device comprising:

a housing having a width substantially that of the width of a single finger, the housing having a massaging surface for contacting the another area to be massaged, the housing having a finger contacting area for contacting the single finger of the user, the finger contacting area located on the opposite side of the device from the massaging surface, the housing having a tip end and a base end opposite the tip end;

a motor for vibrating the massaging device; and, a securing strap fixedly attached to the housing toward the base end of the housing, for securing the massaging device to only the single finger of the user, wherein when the device is strapped to the single finger of the user, the device forms a similar profile as the finger, the massaging surface contacts the another area to be massaged, and the finger contacting area contacts the single finger of the user, wherein a top half and a bottom half of the housing is viewable from the tip end by a plane separating the massaging surface from the finger contacting area, the top half being asymmetrical to the bottom half when viewed from the tip end, and wherein at least one transverse cross section of the housing is non-polygonal.

6. The massaging device of claim 5 wherein the massaging surface has at least one protrusion for giving the massaging surface texture, thereby enhancing the massaging.

7. The massaging device of claim 5 wherein the securing strap is a rigid, two-piece clamp.

8. The massaging device of claim 5 wherein a panel is removably attached to the housing, the panel having the massaging surface thereon for contacting the another area to be massaged.

9. The massaging device of claim 8 wherein the massaging surface of the panel has at least one protrusion for giving the massaging surface texture, thereby enhancing the massaging.

10. For a finger shaped massage device adapted to be secured to only a single finger of a user for contacting an another area to be massaged, the finger shaped massage device comprising:

a housing having a width substantially that of the width of a single finger, the housing having a massaging surface for contacting the another area to be massaged, the housing having a finger contacting area for contacting the single finger of the user, the finger contacting area located on the opposite side of the device from the massaging surface, the housing having further having a tip end and a base end opposite the tip end;

a motor for vibrating the massaging device; and, a securing strap fixedly attached to the housing toward the base end of the housing, for securing the massaging device to only the single finger of the user, wherein when the device is strapped to the single finger of the user, the device forms a similar profile as the finger, the massaging surface contacts the another area to be massaged, and the finger contacting area contacts the single finger of the user, wherein a to half and a bottom half of the housing is viewable from the tip end by a plane separating the massaging surface from the finger contacting area, the top half being asymmetrical to the bottom half when viewed from the tip end, and wherein at least one transverse cross section of the housing is non-polygonal;

a method of using the finger shaped massage device, comprising the steps of:

securing to a front side of only the single finger of the user the finger shaped massaging device; and, applying the massaging surface directly to the another area to be massaged, by applying direct pressure from a front side of only the single finger of the user to the finger contacting area.

11. The method of claim 10 wherein the massaging surface has at least one protrusion for giving the massaging surface texture, thereby enhancing the massaging.

12. The method of claim 10 wherein the securing strap is a rigid, two-piece clamp.

13. The method claim 10 wherein a panel is removably attached to the housing, the panel having the massaging surface thereon for contacting the another area to be massaged.

14. The method of claim 13 wherein the massaging surface of the panel has at least one protrusion for giving the massaging surface texture, thereby enhancing the massaging.

15. The method of claim 10 wherein the securing strap is made from an elastic material.

* * * * *